US005484548A

United States Patent [19]

Kiewert et al.

[11] Patent Number: 5,484,548

[45] Date of Patent: Jan. 16, 1996

[54] LOW-FOAM SCOURING POWDER

[75] Inventors: Eva Kiewert; Lothar Pioch, both of Duesseldorf; Wolfgang Seiter, Neuss; Winfried Wichelhaus, Mettmann, all of Germany

[73] Assignee: Henkel Kommanditgesellschft auf Aktien, Duesseldorf, Germany

[21] Appl. No.: 94,141

[22] PCT Filed: Dec. 19, 1991

[86] PCT No.: PCT/EP91/02451

§ 371 Date: Jul. 29, 1993

§ 102(e) Date: Jul. 29, 1993

[87] PCT Pub. No.: WO92/13936

PCT Pub. Date: Aug. 20, 1992

[30] Foreign Application Priority Data

Jan. 30, 1991 [DE] Germany ..... 41 02 744.2

[51] Int. Cl.[6] ..... C11D 3/22

[52] U.S. Cl. ..... 252/179.17

[58] Field of Search ..... 252/174.17

[56] References Cited

U.S. PATENT DOCUMENTS

| | | | |
|---|---|---|---|
| 3,715,314 | 2/1973 | Morgenstern | 252/95 |
| 4,732,704 | 3/1988 | Biermann et al. | 252/548 |
| 4,839,098 | 6/1989 | Wisotzki et al. | 252/557 |
| 5,258,142 | 11/1993 | Giesen et al. | 252/174.17 X |
| 5,266,690 | 11/1993 | McCurry et al. | 252/174.17 X |
| 5,286,406 | 2/1994 | Scholz et al. | 252/174.17 |
| 5,330,674 | 7/1994 | Urfer et al. | 252/174.17 |

FOREIGN PATENT DOCUMENTS

| | | |
|---|---|---|
| 1048365 | 2/1979 | Canada . |
| 0070074 | 1/1983 | European Pat. Off. . |
| 0411477 | 2/1991 | European Pat. Off. . |
| 1955995 | 7/1971 | Germany . |
| 2539733 | 3/1976 | Germany . |
| 2739776 | 3/1978 | Germany . |
| 3534082 | 4/1987 | Germany . |
| 3706015 | 11/1988 | Germany . |
| 8602943 | 5/1986 | WIPO . |
| 8902912 | 4/1989 | WIPO . |
| 9004630 | 5/1990 | WIPO . |

*Primary Examiner*—Paul F. Shaver
*Attorney, Agent, or Firm*—Ernest G. Szoke; Wayne C. Jaeschke; Henry E. Millson, Jr.

[57] ABSTRACT

Scouring powders containing abrasives and an alkyl glycoside having a degree of oligomerization of from 1.2. to 1.4. These scouring powders are low foaming in the presence of water.

19 Claims, No Drawings

LOW-FOAM SCOURING POWDER

BACKGROUND OF THE INVENTION

1. Field of the Invention

This invention relates to scouring powders which, at the same time, have a good cleaning effect with respect in particular to greasy soil and generate very little foam in use.

2. Statement of Related Art

Scouring powders are among the oldest and, even today, still indispensable cleaning materials which are used both in the home and institutionally for removing obstinate soils. The basic constituents of scouring powders are, on the one hand, the abrasive particles required for mechanically loosening obstinate soil and, on the other hand, surfactants as surface-active agents which are essential for the removal of greasy or fat-containing dirt. The scouring powders currently available on the market almost exclusively contain alkylbenzene sulfonates as surfactants and, from case to case, other active substances and auxiliaries such as, for example, bleaches and disinfectants, zeolites and alkaline salts. German patent applications DE 25 39 733 A1 and DE 27 39 776 A1 (Procter & Gamble) describe scouring liquids and powders in which the abrasive consists of perlite in a quantity of up to 65%. These documents refer mainly to this special abrasive and mention alkyl sulfates and alkylbenzene sulfonates as surfactants for the powders.

Canadian patent 1,048,365 (Procter & Gamble) describes abrasive powders having a high surfactant content of 20 to 35% and an abrasive content of 5 to 20% which are recommended both as scouring powders and as dishwashing detergents. Alkyl sulfates, alkylbenzene sulfonates and fatty alcohol ethoxylates are mentioned as surfactants. A common feature of the scouring powders known from the literature and available on the market is that they have a good cleaning effect with respect to greasy and fat-containing soil, but foam to an undesirably high degree in use. To avoid foaming, attempts have even been made to market pure abrasives without any addition whatever of surfactants. However, scouring powders such as these do not remove grease and, in addition, behave totally unsatisfactorily in use because they cannot be dispersed. Hitherto, it has not been possible to satisfy consumer demand for low-foaming scouring powders with a good cleaning effect.

DESCRIPTION OF THE INVENTION

Accordingly, the problem addressed by the present invention was to provide scouring powders of the desired type which would combine both product effects, namely good soil removal and low foaming.

Surprisingly, this problem has been solved by addition to the scouring powders of alkyl glycosides having a degree of oligomerization of 1.2 to 1.4 or surfactant combinations containing these alkyl glycosides. The scouring powders may additionally contain typical ingredients.

Accordingly, the present invention relates to low-foam scouring powders containing abrasives, other typical ingredients and, optionally, other surfactants, characterized in that they contain an addition of alkyl glycosides having a degree of oligomerization of 1.2 to 1.4.

Alkyl glycosides are known as degradable surfactants of native origin. In general, the alkyl glycosides used as surfactants in accordance with the present invention may be represented by the structural formula $RO(G)_x$, where R is an aliphatic radical containing at least 4 carbon atoms, preferably the residue of a primary alcohol and, more preferably, a fatty alkyl or fatty alkenyl radical containing 8 to 22 and preferably 12 to 18 carbon atoms. The symbol (G) in the formula stands for a glycose unit, glucose being preferred by virtue of its ready availability on the one hand and its high reactivity on the other hand. Finally, the index x is a number of 1.2 to 1.4 which indicates the so-called degree of oligomerization, i.e. the distribution of monoglycosides and oligoglycosides. In the representation of the alkyl glycosides by the formula $RO(G)_x$, the fatty alcohol component is disregarded. In principle, this fatty alcohol component may largely be controlled by careful distillation of the alkyl glycoside, i.e. the fatty alcohol excess emanating from the reaction can be removed from the product to residues of less than 1% of the total component. They were proposed inter alia for liquid manual dishwashing detergents, for example in WO 86/02943 (A. E. Staley) and WO 89/02912 (Henkel Corp.). However, manual dishwashing detergents are required by the consumer to develop high foaming power in contrast to other cleaning preparations for hard surfaces. A foaming surfactant composition containing a special surface-active alkyl glycoside having a degree of oligomerization x of 1.5 to 10 and an alkyl monoglycoside content of 20 to 70% by weight together with an anionic co-surfactant selected from the group consisting of surface-active sulfates, sulfonates, carboxylates and mixtures thereof is described in EP 0 070 074 A2 (Procter & Gamble). The anionic co-surfactants mentioned include, in particular, alkylbenzene sulfonate, soap, zwitterionic surfactants, amphoteric surfactants, alkane sulfonates, alpha-olefin sulfonates, alkyl sulfates, alkyl polyglycol ether sulfates and paraffin sulfonates and mixtures thereof. The surfactant compositions described in this document are suitable for the production of products which foam liberally in use, such as for example manual dishwashing detergents and shampoos. The possible addition of abrasives is also mentioned enumeratively in the specification, although no examples of this are provided. DE 35 34 082 A1 (Henkel KGaA) describes liquid manual dishwashing detergents containing sulfate and/or sulfonate surfactants, fatty acid alkanolamides and fatty alkyl glucosides with a degree of oligomerization of 1 to 1.4 which show particular foaming and cleaning power. There is no mention of a scouring effect.

In addition, DE 37 06 015 A1 (Henkel KGaA) describes liquid high-foaming manual dishwashing detergents which, in addition to fatty alkyl glucosides having a degree of oligomerization of 1 to 1.4, contain dialkyl sulfosuccinates with 7 to 9 carbon atoms in each of the alkyl radicals as foam boosters. Once again, there is no reference to an abrasive effect. Accordingly, it was not foreseeable that these alkyl glycosides would produce very little foam in use either on their own or in combination with other surfactants in scouring powders.

Preferred scouring powders according to the present invention have the following composition:

a) 70 to 99% by weight and, more particularly, 80 to 95% by weight of an abrasive, b) 0.5 to 15% by weight and, more particularly, 1 to 10% by weight of a surfactant or surfactant mixture from the group of anionic, nonionic or amphoteric surfactants, 2 to 100% and preferably 5 to 90% of this surfactant or surfactant mixture consisting of the alkyl glucoside, and c) the balance to 100% by weight substances typically used in scouring powders, such as bleaches and disinfectants, inorganic or organic water-soluble or insoluble salts, dyes and fragrances.

Other surfactants which may be used in the scouring powders according to the invention are anionic surfactants of the sulfate and sulfonate type, such as for example alkyl sulfates, alkyl ether sulfates, alkylbenzene sulfonates, alkyl sulfonates, etc., which are typically used in cleaning preparations. Preferred other surfactants are alkyl sulfates with a saturated or unsaturated $C_{6-20}$ and preferably $C_{10-18}$ alkyl radical produced in known manner from natural oils and fats. Scouring powders free from alkylbenzene sulfonates are particularly preferred.

Suitable nonionic surfactants are fatty alcohol ethoxylates, i.e. addition products of 2 to 16 mol ethylene oxide with fatty alcohols containing branched or straight-chain, saturated or unsaturated $C_{16-20}$ alkyl radicals. Fatty alcohol ethoxylates prepared from natural fats and oils are preferred. Typical amphoteric surfactants and betaines and/or amidobetaines may also be used in small quantities. However, in cases where surfactants of this class are employed, the quantities in which they are used should be adapted to the possible presence of other surfactants, so that the formulation as a whole shows the desired foaming behavior.

Suitable abrasives are any of the substances known for scouring powders, for example mineral crushed rocks, such as silica, crystobalite, marble and pumice flours and the like with a particle size of up to 1 mm and preferably up to 0.3 mm. The lower limit to the particle size is imposed solely by the technical possibilities for the production of abrasives, even in flour-like forms suitable for additions of polishes. Alternatively, granular or powder-form plastics, wood powder or glass beads and similar abrasives having a very mild scouring effect may also be used.

Suitable bleaches and disinfectants are any of the known inorganic or organic compounds which yield $H_2O_2$ or active chlorine in the presence of water. The per compounds may be used together with so-called bleach activators, such as for example tetraacetyl ethylene diamine or tetraacetyl glycol uril.

Other substances which may optionally be used in scouring powders include inorganic or organic complexing agents and builders which are capable of binding alkaline earth metal ions present in tapwater—used to apply the scouring powders—and which lead to an increase in the cleaning effect in conjunction with the surfactants. This class of active substances includes the known zeolites and organic complexing agents, more particularly the sodium salts of polycarboxylic acids, hydroxycarboxylic acids, aminocarboxylic acids, carboxyalkyl ethers, polyanionic polymers, more particularly polymeric carboxylic acids. P-containing complexing agents or builders are preferably not used.

Finally, it may be desirable to add alkali metal salts showing a neutral or alkaline reaction, more particularly sodium salts, from the group of chlorides, carbonates, bicarbonates, sulfates and silicates to the scouring powders.

The scouring powders according to the invention may also contain dyes and fragrances. Where oxidative bleaches are present, known oxidation-stable pigments, such as phthalocyanine pigments or ultramarine, and fragrances, such as terpene compounds, are selected.

The scouring powders may be produced in known manner, for example by drying all or part of the water-soluble components and adding or spraying on the remaining components of the scouring powder.

Test Method

The cleaning effect of the scouring powders according to the invention was tested by the method published in the journal Seifen-Öle-Fette-Wachse, 112, 371 (1986). The cleaning preparation to be tested is applied to an artificially soiled plastic surface. A mixture of Vaseline®, fatty acid glycerol esters and pigments was used as the artificial soil. The test surface measuring 26×28 cm was uniformly coated with 2 g of the artificial soil using a surface spreader.

A plastic sponge was soaked with tapwater. The scouring powder to be tested was applied to the test surface in the form of a 1:1 mixture with tapwater. The sponge was then mechanically moved over the test surface. After 10 wipes, the cleaned test surface was held under running water to remove the loose dirt. The cleaning effect, i.e. the whiteness of the plastic surface thus cleaned, was measured with a Dr. Lange Microcolor—an instrument for measuring color difference. The clean white plastic surface served as the white standard.

Since the instrument was set at 100% during measurement of the clean surface and since the soiled surface produced a reading of 0, the values read off for the cleaned plastic surfaces may be equated with the percentage cleaning power (% CP). In the following tests, the CP rel. (%) values shown are the values determined by this method for the cleaning power of the cleaning preparations tested, based on the cleaning performance of the comparison standard (CP=100%). They each represent the average value of 3 determinations.

Foaming behavior was tested by the following method in which the foam formed during scouring was tested on a clean tiled table top. For the foaming test, 1.0 g scouring powder and 10 ml tapwater were applied to the table. Scouring was carried out in 15 circular movements using moistened hand brushes and the foam generated was evaluated on a scale of 1 to 4 where 4=abundant foam and 1=little or no foam.

A commercial scouring powder of the following composition was used as the comparison standard for the effects obtained with the scouring powders according to the invention:

3.0% Na alkylbenzene sulfonate
3.0% Na hydrogen carbonate
1.3% K peroxomonosulfate
0.3% Na sulfate
4.0% Na chloride
Balance to 100% silica flour.

The cleaning effect determined by the described test for this powder was equated with 100%. This product achieved the following scores in the foam test:

| Evaluation after | 0 | 1 | 5 minutes |
|---|---|---|---|
| Scores | 4 | 3 | 2–3 |

In the following Examples, the percentages are based on % by weight active substance.

EXAMPLE 1

0.5% $C_{12-14}$ alkyl glucoside with x=1.4
1.0% $C_{12-14}$ fatty alcohol sulfate, Na salt
1.0% Zeolite
1.5% Waterglass
1.5% Soda
0.2% Perfume oil
Balance to 100% silica flour, particle size 0–0.1 mm The relative cleaning power based on the comparison standard was 120%. The foam scores were as follows:

| Evaluation after | 0 | 1 | 5 minutes |
|---|---|---|---|
| Scores | 1–2 | 1 | 1 |

EXAMPLE 2

0.1% $C_{12-14}$ alkyl glucoside with x=1.4
0.05% $C_{12-18}$ fatty alcohol +5 ethylene oxide (EO)
1.5% $C_{12-14}$ fatty alcohol sulfate
2.0% Soda
10.0% Na sulfate
0.008% Dye
Balance to 100% polypropylene granules, particle size 0–0.3 mm This is a very mildly abrasive scouring powder with a relative cleaning power of 150% and minimal foaming.

| Evaluation after | 0 | 1 | 5 minutes |
|---|---|---|---|
| Scores | 1–2 | 1 | 1 |

EXAMPLE 3

The composition was the same as in Example 2, except that marble powder (particle size 0–0.2 mm) was used instead of the plastic granules. This low-foaming scouring powder was equal in its cleaning effect to the scouring powder of Example 2.

EXAMPLE 4

0.15% $C_{12-14}$ alkyl glucoside with x=1.2
1.5% $C_{12-14}$ fatty alcohol sulfate
2.0% Soda
1.5% Waterglass
1.0% Zeolite
1.0% Sulfate
2.0% Potassium monopersulfate
Balance to 100% marble powder, particle size 0–0.1 mm This scouring powder had a good bleaching effect on fruit stains and was stable in storage. Relative cleaning performance: 130%

| Evaluation after | 0 | 1 | 5 minutes |
|---|---|---|---|
| Scores | 1–2 | 1 | 1 |

EXAMPLE 5

0.5% $C_{12-14}$ alkyl glucoside with x=1.4
3.0% $C_{12-14}$ fatty alcohol sulfate
0.1% $C_{12-18}$ fatty alcohol +5 EO
0.5% Polyacrylate (Sokalan™ CP 5, a product of BASF)
3.0% Zeolite
0.1% Mg perphthalate
Balance to 100% silica flour, particle size 0–0.05 mm Despite its excellent relative cleaning effect of 200%, this bleaching scouring powder produced very little foam.

| Evaluation after | 0 | 1 | 5 minutes |
|---|---|---|---|
| Scores | 2 | 1–2 | 1 |

EXAMPLE 6

0.15% $C_{12-14}$ alkyl glucoside with x=1.2
0.5% Alkylbenzene sulfonate, Na salt
2.0% Soda
1.5% Waterglass
3.0% Na sulfate
1.0% Zeolite
0.1% Trichloroisocyanuric acid
0.002% Dye
0.2% Perfume oil
Balance to 100% silica flour, particle size 0–0.1 mm

| Evaluation after | 0 | 1 | 5 minutes |
|---|---|---|---|
| Scores | 3 | 2–3 | 2 |

Even with a content of alkylbenzene sulfonate, foaming is still demonstrably reduced by addition of the alkyl glucoside.

EXAMPLE 7

5% $C_{12-14}$ alkyl glucoside with x=1.4
5% Soda
90% Silica flour, particle size 0–0.1 mm
Relative cleaning performance: 150%

| Evaluation after | 0 | 1 | 5 minutes |
|---|---|---|---|
| Scores | 1 | 1 | 1 |

The best effect is obtained when alkyl glucoside is used as the sole surfactant.

We claim:

1. A low-foaming scouring powder comprising

A) from 70 to 99% by weight of an abrasive;

B) from 0.5 to 15% by weight of a surfactant component comprising at least one anionic, nonionic, or amphoteric surfactant wherein from 2 to 100% thereof is at least one alkyl glycoside having a degree of oligomerization of from 1.2 to 1.4; and C) balance to 100% by weight of other components compatible with scouring powders.

2. The scouring powder of claim 1 wherein component A is present in from 80 to 95% by weight.

3. The scouring powder of claim 1 wherein component B is present in from 1 to 10% by weight.

4. The scouring powder of claim 1 wherein in component B from 5 to 90% thereof is an alkyl glycoside having a degree of oligomerization of from 1.2 to 1.4.

5. The scouring powder of claim 2 wherein component B is present in from 1 to 10% by weight.

6. The scouring powder of claim 5 wherein 100% of component B is at least one alkyl glycoside having a degree of oligomerization of from 1.2 to 1.4.

7. The scouring powder of claim 1 wherein component C is at least one of a bleach, disinfectant, inorganic salt, organic salt, dye, and fragrance.

8. The scouring powder of claim 1 wherein in component B the alkyl glycoside has the formula $$RO(G)_x$$

wherein R is a $C_4$–$C_{22}$ alkyl group, O is oxygen, G is a glycose unit, and x is a number of from 1.2 to 1.4.

9. The scouring powder of claim 8 wherein R is a fatty alkyl or fatty alkenyl group having from 8 to 22 carbon atoms.

10. The scouring powder of claim 9 wherein the R group has from 12 to 18 carbon atoms.

11. The scouring powder of claim 8 wherein G is a glucose unit.

12. The scouring powder of claim 1 which is free from alkylbenzene sulfonates.

13. The scouring powder of claim 1 which is free from phosphorus-containing complexing agents and builders.

14. The scouring powder of claim 1 wherein component B consists of from 5 to 90% of an alkyl glycoside having a degree of oligomerization of from 1.2 to 1.4 and from 95 to 10% of an alkyl sulfate in which the alkyl group is saturated or unsaturated and contains from 6 to 20 carbon atoms.

15. The scouring powder of claim 14 wherein the alkyl group of the alkyl sulfate contains from 10 to 18 carbon atoms.

16. The scouring powder of claim 1 wherein component A is a crushed rock having a particle size of up to 1 mm, a granular or powder form plastic, wood powder, glass beads, or mixtures of two or more of the foregoing.

17. The scouring powder of claim 1 wherein component A is present in from 80 to 95% by weight; component B is present in from 1 to 10% by weight, and the alkyl glycoside is an alkyl glycoside of the formula $$RO(G)_x$$

wherein R is a $C_4$–$C_{22}$ alkyl group, O is oxygen, G is a glycose unit, and x is a number of from 1.2 to 1.4; component C is at least one of a bleach, disinfectant, inorganic salt, organic salt, dye and fragrance; and the scouring powder is free from alkylbenzene sulfonates and from phosphorus-containing complexing agents and builders.

18. The scouring powder of claim 17 wherein in the alkyl glycoside R is a fatty alkyl or fatty alkenyl group having from 8 to 22 carbon atoms and G is a glucose unit, and 100% of component B is the alkyl glycoside.

19. The scouring powder of claim 17 wherein component B consists of from 5 to 90% of an alkyl glycoside having a degree of oligomerization of from 1.2 to 1.4 and from 95 to 10% of an alkyl sulfate in which the alkyl group is saturated or unsaturated and contains from 6 to 20 carbon atoms.

* * * * *